US006286401B1

(12) United States Patent
Hajianpour

(10) Patent No.: US 6,286,401 B1
(45) Date of Patent: Sep. 11, 2001

(54) SCREWDRIVER WITH HOLDING FEATURE FOR SOCKET HEAD SCREWS

(76) Inventor: Mohammed Ali Hajianpour, 1706 Vestal Dr., Coral Springs, FL (US) 33071

( * ) Notice: Subject to any disclaimer, the term of this patent is extended or adjusted under 35 U.S.C. 154(b) by 0 days.

(21) Appl. No.: 09/590,054

(22) Filed: Jun. 8, 2000

(51) Int. Cl.[7] ..... B25B 23/08
(52) U.S. Cl. ..... 81/453
(58) Field of Search ..... 81/121.1, 124.6, 81/90.2, 442, 443, 444, 445, 453, 455, 186; 403/371; 411/55, 57

(56) References Cited

U.S. PATENT DOCUMENTS

| | | | | |
|---|---|---|---|---|
| 1,271,816 | * | 7/1918 | White | 81/443 |
| 1,592,987 | * | 7/1926 | Mayer | 433/161 |
| 1,688,181 | * | 10/1928 | Fink | 81/455 |
| 1,699,266 | * | 1/1929 | Applestine | 81/58.3 |
| 1,758,162 | * | 5/1930 | Lemieux | 81/443 |
| 2,506,922 | * | 5/1950 | Hansen | 81/444 |
| 2,556,395 | * | 6/1951 | MacLean | 81/443 |
| 3,121,572 | * | 2/1964 | Torok | 279/50 |
| 3,782,432 | | 1/1974 | Allen | 81/444 |
| 3,825,048 | * | 7/1974 | Triska | 81/444 |
| 3,902,384 | * | 9/1975 | Ehrler | 81/445 |
| 4,328,721 | * | 5/1982 | Massari | 81/439 |
| 4,581,962 | | 4/1986 | Marbourg | 81/451 |
| 4,779,494 | | 10/1988 | Quach | 81/443 |
| 4,827,812 | | 5/1989 | Markovetz | 81/439 |
| 5,025,688 | | 6/1991 | Davis | 81/448 |
| 5,056,387 | | 10/1991 | Cook | 81/456 |
| 5,279,187 | * | 1/1994 | Salmon | 81/53.2 |
| 5,954,463 | * | 9/1999 | Jore | 408/239 R |

* cited by examiner

*Primary Examiner*—Derris H. Banks
*Assistant Examiner*—David B Thomas
(74) *Attorney, Agent, or Firm*—Ronald V. Davidge

(57) ABSTRACT

A screwdriver has a drive bit with a drive portion for engaging a socket within a socket-headed screw, with the drive portion being expanded by the distal end of an internal pushrod operating on the conical surface of a hold within the drive bit. The pushrod extends in a central hole within a housing. The housing may include a handle portion and a hollow shaft, with a threaded knob engaging the handle portion to move the pushrod. The drive bit may be a fixed portion of the screwdriver or an interchangeable part.

8 Claims, 4 Drawing Sheets

SCREWDRIVER WITH HOLDING FEATURE FOR SOCKET HEAD SCREWS

BACKGROUND OF THE INVENTION

1. Field of the Invention

This invention relates to a screwdriver having a provision for holding a screw in place on its tip before the screw is installed or after it is removed, more particularly, to such a screwdriver having a hexagonally-shaped tip for engaging a screw having a screw having a hexagonally-shaped socket in its head, and to such a screwdriver configured for installing and/or removing screws installed in bone during surgical procedures.

2. Description of the Related Art

In many surgical procedures, such as the repair of fractured bones, screws of various types are driven into bone. While these screws are often left in place, sometimes they must be removed. In the process of installing or removing such screws, it is of particular importance that the screw not be dropped from the screwdriver, as it is often difficult to find a screw lost within the surgical site. In many such applications, the screw threads cut mating threaded surfaces in bone during the installation of a screw. Thus, it is also important to maintain a tight relationship between the screwdriver and the screw itself during the process of installing the screw, so that such threaded surfaces can be accurately cut, without unnecessarily widening the threaded surfaces being cut or otherwise weakening the threaded bone through wobbling movements occurring between the screwdriver and the screw. Furthermore, the screwdriver should be easily and completely releasable from the screw under control of the user, so that it can be removed from an installed screw without weakening the attachment of the screw within fragile bone.

The patent literature includes a number of examples of screwdrivers operating with socket-headed screws having a capability to hold and release the screws while providing the required driving torque. For example, U.S. Pat. No. 5,025,688 describes a fastener drive tool for applying a rotational torque to a threaded fastener for driving the fastener into or out of a workpiece. The drive tool has an elongated shaft portion with a free end which is selectively controllably engageable with a recess formed in the fastener. The free end is formed with a fastener engaging expansion portion. The expansion portion is operated by a draw shaft being selectively lockable in a bit retaining position. The expansion portion of the bit portion creates substantial fastener retaining forces on the opposing internal surfaces of the fastener recess in which it is inserted.

In a first embodiment of this prior-art fastener drive tool, the expansion portion is an elastomeric disk having a central hole through which the draw shaft extends. When the draw shaft is pulled upward, an enlarged head portion of the draw shaft axially compresses the elastomeric disk, causing it to expand radially into engagement with a socket within the screw head. The engagement torque and holding forces between the screwdriver and the screw are thus limited by the radial forces which can be generated within the elastomeric disk in this way, and by a reduction of the overlapping engagement distance between the socket driving surfaces extending above the elastomer and the socket. This distance is reduced by the presence of both the enlarged head portion of the draw shaft and of the elastomeric disk within the screw head socket.

In a second embodiment of this prior-art fastener drive tool, the expansion portion comprises the tip, which includes a vertical slit and conical bore having its enlarged end at the end of the tool and its narrow end beginning at a cylindrical hole provided for the draw shaft. The draw shaft includes an enlarged conical end, which is pulled upward into the conical bore, causing the tip to expand at the vertical slit. Thus, the engagement torque which can be established between the screwdriver and the screw is limited by the inclusion of both the slot and the relatively large conical bore as spaces within the tip.

U.S. Pat. No. 4,779,494 describes a screw-gripping screwdriver including a handle, a shaft composed of two blade members, a sleeve which is disposed coaxially about the blade members, and a tip. The blade members have inclined surfaces which cooperate with the sleeve so that, during movement of the sleeve along the blade members, a camming action occurs so that a relatively large movement of the sleeve causes a relatively small movement of the blade tips. In one embodiment, the blade tip members have portions which are generally trapezoidal in shape suitable for use with a hexagonal opening in a hex head screw. However, the degree of precision with which the screw can be handled is limited by the flexibility of the blade members, which are flexed by the torque used to turn the screw. Furthermore, the screw is released from the screwdriver by pulling the sleeve so that the camming action is reversed, causing a movement of the blade tip members that may tend to loosen a screw fastened into fragile bone tissue.

U.S. Pat. No. 4,581,962 describes an invention comprising basically a combination of a barrel and collar, preferably made of stiff but flexible plastic, which fit over and enclose a tool for threaded fasteners, either with a fixed bit or one which can accept insertable bits. The barrel provides at its working or tip end a set of flexible elements which act to grip screw heads and hold them registered with the tool. The barrel can be fixed in place on the tool shaft by a partial turn of either form of collar. Collar works with a spring to move the barrel into gripping position. A variation for jewelers' screwdrivers uses a miniature barrel without a collar but with a spring. This method is limited by a requirement that both the socket in the screwhead and the peripheral surface of the screwhead must be controlled within tight limits to allow proper engagement of the tool.

U.S. Pat. No. 5,056,387 describes a screw-holding screwdriver having a sleeve threadedly attached to its shank. A chuck on the end of the sleeve has a slot in the side to receive a screw head and shank. By screwing the sleeve up on the shank, the screwdriver bit engages the screw head and clamps the screw head in the chuck for driving the screw. When partially inserted, the sleeve is rotated on the shank to release the screw to permit removal of the chuck from the screw. In this way, the screw is firmly retained while driving. However, the use of this screwdriver is limited by the fact that the distal portion of the chuck extends between the bottom of screwhead and the outer surface of the material into which the screw is being driven. Before the screwhead can be driven to the surface of the material, the screwdriver must be removed from the screwhead so that the drive bit can be extended through an opening in the lower portion of the chuck. In an operation requiring the driving of a screw into fragile bone, or the removal of a screw from such bone, it is desirable to be able to grip the head of the screw throughout the attachment or removal process.

Other examples of patent literature, such as U.S. Pat. No. 4,827,812, describe screwdrivers having interchangeable bits without mechanisms for releasably holding the screws to be driven or removed using the interchangeable bits. What is needed is a single mechanism for both holding an interchangeable bit in place on the end of a screwdriver and for releasably holding a screw in place on the interchangeable bit.

The present invention, which is described in detail below, overcomes the various disadvantages of the prior art, as described above.

BRIEF SUMMARY OF THE INVENTION

A first objective of the present invention is to provide a screwdriver having a capability of rotationally driving a screw having a socket head and releasably holding the head of the screw.

Another objective of the present invention is to provide a screwdriver applying both a driving torque and a holding force through the socket surfaces of a socket head screw.

Another objective of the present invention is to provide a screwdriver having user controlled means for holding a socket head screw rigidly and for completely releasing the socket head screw.

Another objective of the present invention is to provide a screwdriver having a single mechanism for holding an interchangeable bit in place within the screwdriver and for holding a screw in place on the interchangeable bit.

According to a first aspect of the present invention, there is provided apparatus for turning a screw having a head with a socket. The apparatus includes a housing, a pushrod, and a drive bit. The housing has a proximal housing end, a distal housing end, and a central hole extending between the proximal and distal ends. The pushrod extends through the central hole. The drive bit, which is attached to the distal housing end, includes a segmented drive structure for engaging the socket and an internal actuation surface inclined relative to the central hole. Movement of a distal rod end of the pushrod in a distal direction in engagement with the internal actuation surface causes segments of the segmented drive structure to expand relative to each other for holding the screw by the socket.

According to a second aspect of the present invention, the housing includes a hollow shaft extending to the distal housing end and a handle extending to the proximal housing end.

DETAILED DESCRIPTION OF THE INVENTION

Figure 1:
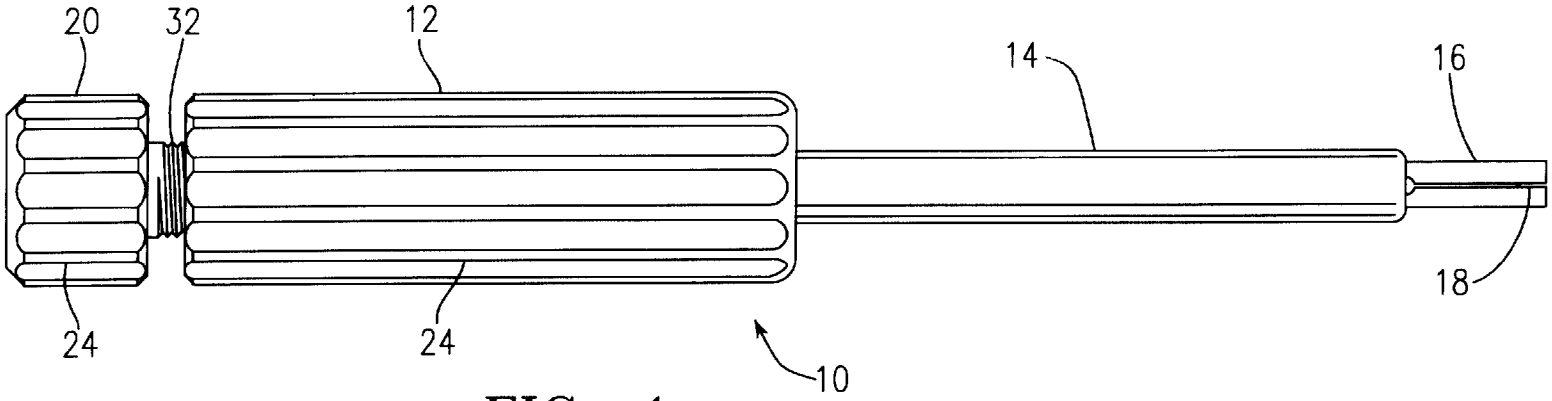
FIG. 1 is a side elevation of a screwdriver built in accordance with a first version of the present invention.
Figure 3:
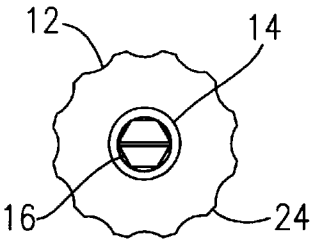
FIG. 3 is a right end elevation thereof.
Figure 2:
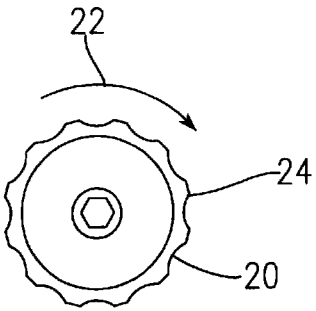
FIG. 2 is a left end elevation of the screwdriver of FIG. 1.

FIGS. 1–3 are elevational views of a screwdriver 10 built in accordance with a first version of the present invention, with FIG. 1 being a side elevation thereof, with FIG. 2 being a left end elevation thereof, and with FIG. 3 being a right end elevation thereof. The screwdriver 10 includes a main handle 12 from which a hollow shaft 14 extends to hold a hexagonally shaped drive bit 16. The drive bit 16 is of a size and shape allowing its distal end 18 to be inserted into the socket of a standard socket-head screw or setscrew. The screwdriver 10 further includes a clamping handle 20, which is rotated in the direction of arrow 22 to cause expansion of the drive bit 16, so that a screw having a socket head over the distal drive bit end 18 is firmly held thereon. Thereafter, rotating the clamping handle 20 opposite the direction of arrow 22 causes such a screw to be released from the distal drive bit end 18. Both the main handle 12 and the clamping handle 20 have fluted peripheral surfaces 24 to facilitate manual turning.

Figure 4:
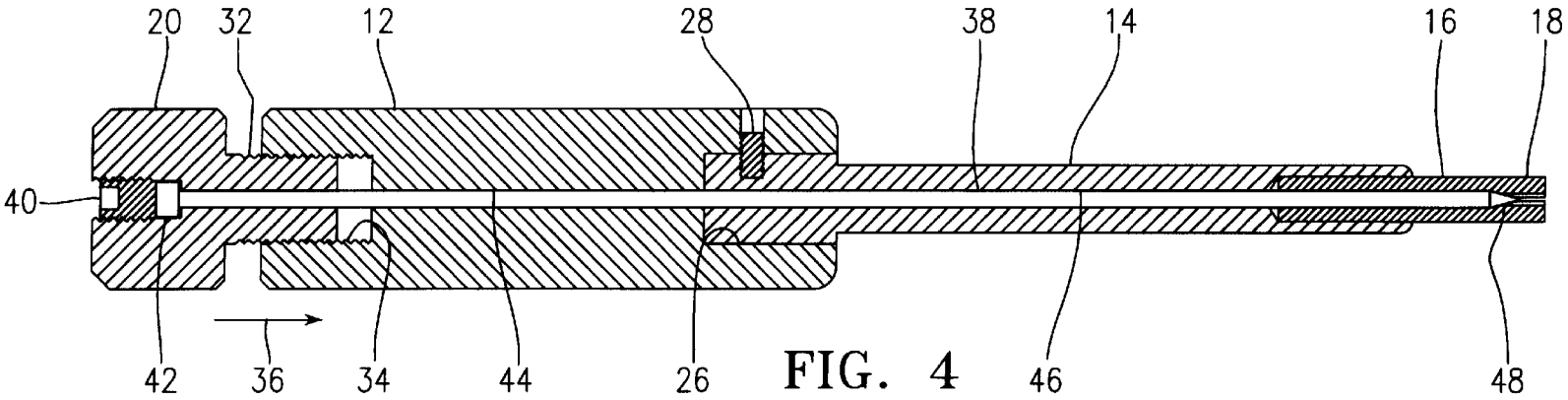
FIG. 4 is a longitudinal cross-sectional view thereof.

FIG. 4 is a longitudinal cross-sectional view of the screwdriver 10. The hollow shaft 14, which is inserted into a hole 26 within the main handle 12, is held in place by means of a setscrew 28. The clamping handle 20 includes a hub 30 with external threads 32 engaging internal threads 34 within a hole 36 in the proximal end of the main handle 12, so that rotation of the clamping handle 20 in the direction of arrow 22 (shown in FIG. 2) results in the inward movement of the clamping handle 20, in the direction of arrow 36. A clamping rod 38 is fastened within the clamping handle 20 by means of a setscrew 40 pressing against a flange 42 of the rod 38. The clamping rod 38 extends, through a longitudinally extending hole 44 within the main handle 12, and through a longitudinally extending hole 46 within the hollow shaft 14, to a tapered rod end 48 within the drive bit 16.

Figure 5:
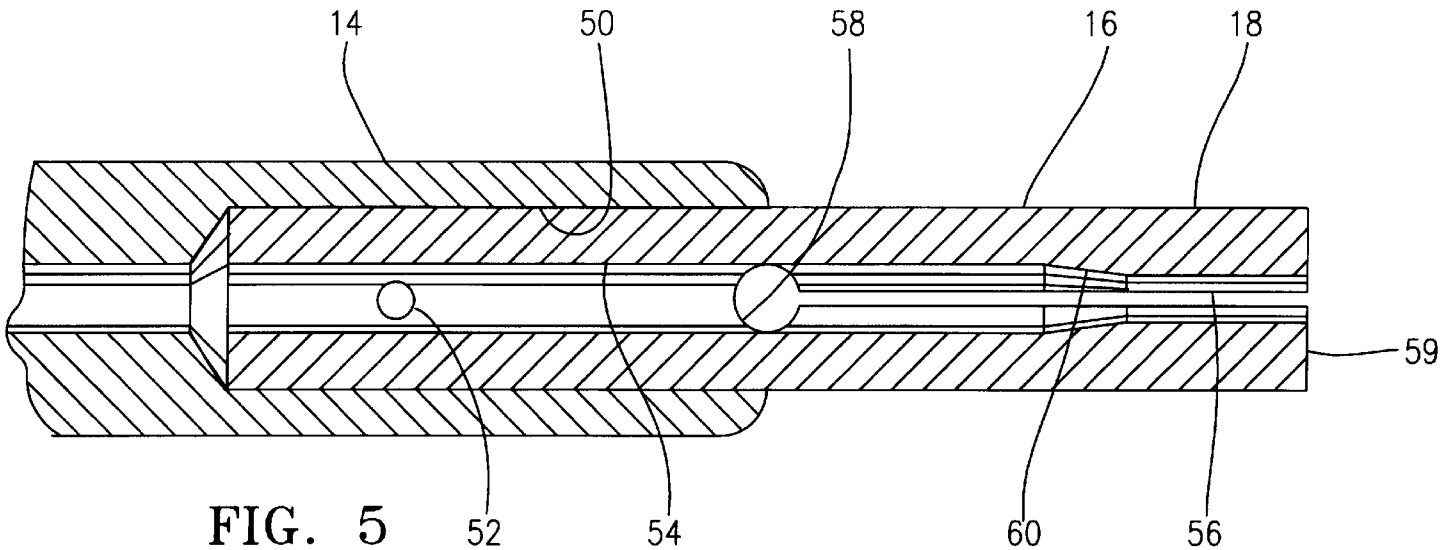
FIG. 5 is a fragmentary longitudinal cross-sectional view of a distal tip portion thereof with a clamping rod removed therefrom.

FIG. 5 is a fragmentary longitudinal cross-sectional view of the drive bit 16 with the clamping rod 38 removed to reveal the slotted internal structure of the drive bit 16, which fits within a corresponding hole 50 at the distal end of the hollow tube 14. This hole 50 may be hexagonal to match the external shape of the drive bit 16, or it may be round, engaging the hexagonal points of the drive bit 16. A pin 52, extending between the annular structures of the hollow tube 14 and the drive bit 16, but not extending into the hole 54 within the drive bit 16, may be used to hold the drive bit 16 firmly in place within the hole 50. A slot 56 extends, through the distal end 18 of the drive bit 16, to a hole 58, which is included to limit the stress concentration which would otherwise occur at the end of the slot 56. This slot 56 divides the distal drive bit end 18 into bifurcated sections 59. The hole 54 within the drive bit 16 includes a tapered section 60, which is engaged by the tapered drive bit 48 of the clamping rod 38 (shown in FIG. 4).

Referring to FIGS. 4 and 5, the external surfaces of the drive bit 16 are preferably configured so that a conventional socket-head screw or setscrew is loosely held on the distal end 18 of the drive bit 16 with the drive bit 16 in an undeflected condition. Such a condition occurs when the clamping rod 38 is withdrawn, opposite the direction of arrow 36, with its tapered tip 48 out of contact with the tapered section 60 of hole 54. Subsequent rotation of the clamping handle 20 in the direction of arrow 22 (shown in FIG. 2) causes the clamping rod 38 to be rotated and extended longitudinally in the direction of arrow 36. As the tapered rod tip 48 is thrust against tapered section 60, the bifurcated sections 59 are deflected apart, increasing the gap of slot 56 and the engagement force between the distal drive bit portion 18 and a socket-headed screw placed thereon. Subsequently, as the clamping handle 24 is rotated opposite the direction of arrow 22, the clamping rod 38 is withdrawn longitudinally, opposite the direction of arrow 36, with the drive bit 16 returning to its undeflected state to release a socket-headed screw or setscrew held thereon.

While the preceding discussion has been limited to a drive bit 16 split into two bifurcated sections 59 by a single slot 56, it is understood that the drive bit could be divided into 3, 4, or more sections within the scope of the present invention.

Figure 6:
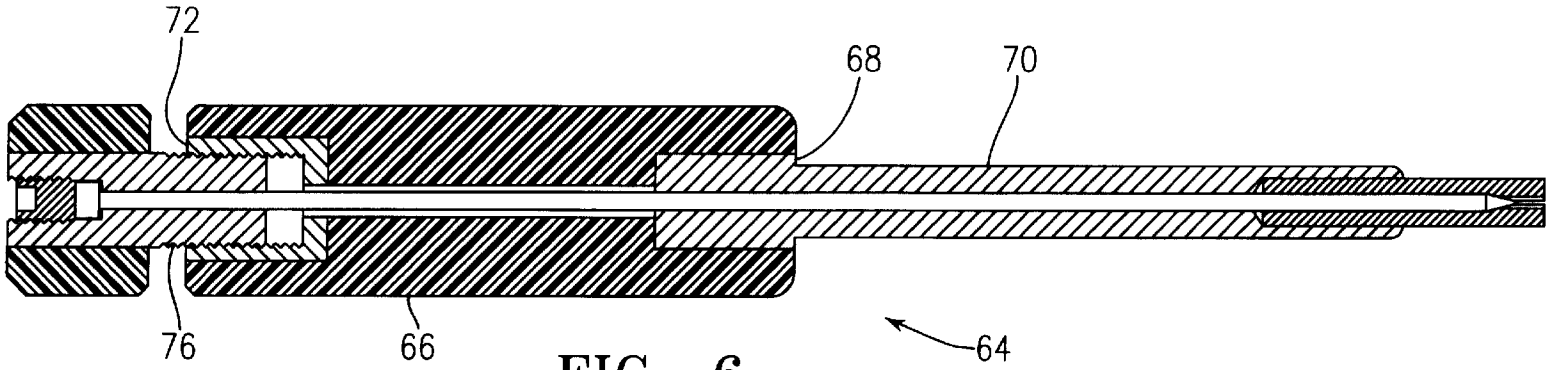
FIG. 6 is a longitudinal cross-sectional view of a screwdriver built in accordance with a second version of the present invention.

FIG. 6 is a longitudinal cross-sectional view of a screwdriver 64 built in accordance with a second version of the present invention. This screwdriver 64 includes a thermoplastic main handle 66 molded onto a hub portion 68 of a hollow tube 70 and onto a threaded metal insert 72. The clamping handle 74 also includes a thermoplastic portion molded over a metal hub 76. The peripheral surfaces of hub portion 68 and threaded insert 72 are preferably roughened to facilitate a strong mechanical bond with the thermoplastic material. In other respects, the construction and operation of this screwdriver 64 is the same as that of screwdriver 10, as described above in reference to FIGS. 1–5.

Figure 7:
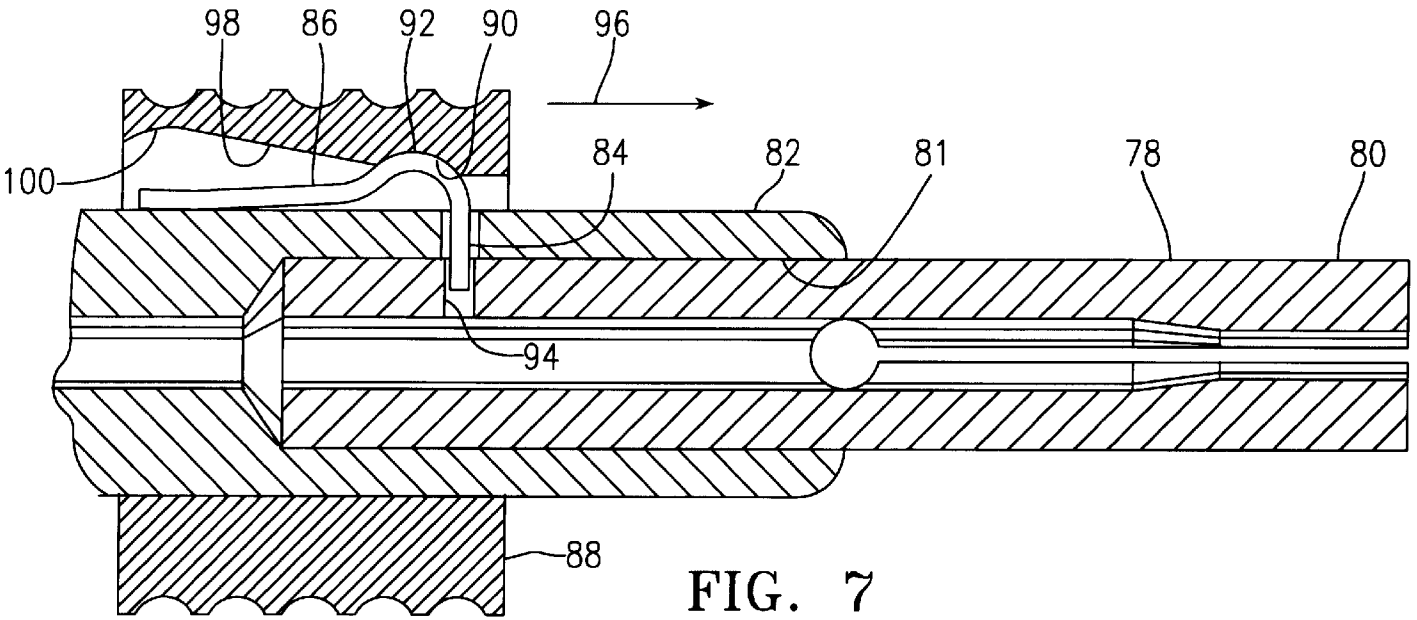
FIG. 7 is a fragmentary cross-sectional view taken as FIG. 5, showing an alternative construction including means for replacing tips.

FIG. 7 is a fragmentary longitudinal cross-sectional view of a screwdriver having an alternative construction providing for the removal and replacement of a drive bit 78. This alternative construction is employed in a screwdriver otherwise built in accordance with the first version of the present invention, as described above in reference to FIGS. 1–5, and also in a screwdriver otherwise built in accordance with the second version of the present invention, as described above in reference to FIG. 6. This feature of FIG. 7 can be used to provide for the use of a number of interchangeable drive bits 78, having distal portions 80 of differing sizes and shapes, for fastening different types of screws or setscrews. The drive bit 78 is slidable within a hole 81 of a hollow shaft 82, being held in place by a tab 84 extending inward as a part of a latching spring 86 fastened to the outer surface of the hollow shaft 82. In the locked position shown in FIG. 7, a sliding collar 88 is positioned so that a first detent surface 90 in the collar 88 holds the curved portion 92 of the latching spring 86 in a position assuring that the tab 84 extends into a slot 94 within the drive bit 78. As the collar 88 is slid in the direction of arrow 96, the curved portion 92 moves along an inclined surface 98 within the collar 88, into a second detent surface 100, with the tab 84 moving outward from the slot 94 to release the drive bit 78. When the latching spring 86 is undeflected, the tab 84 is fully removed from the slot 94. The process of latching a drive bit 78 in place within the hole 80 occurs in the reverse manner. The drive bit 78 is fully inserted within the hole 81 with the collar 88 moved in the direction of arrow 96. Next, the collar 88 is slid opposite the direction of arrow 96, with the tab 84 being pushed into the slot 94. While a single latching spring 86 is shown in FIG. 7, it is understood that a number of such springs, spaced around the hollow shaft 82, could be simultaneously engaged and disengaged by a single sliding collar 88.

Figure 8:
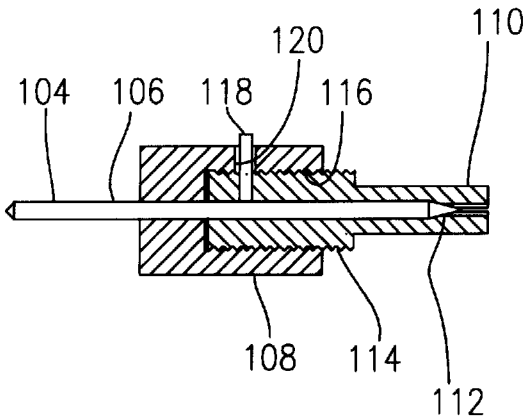
FIG. 8 is a longitudinal cross-sectional view of a screwdriver built in accordance with a third version of the present invention.

FIG. 8 is a longitudinal cross-sectional view of a screwdriver 102, built in accordance with a third version of the present invention, being configured particularly for attachment to a power drill and for the removal of screws or setscrews having hexagonal socket heads. A proximal portion 104 of a central shaft 106 is configured for attachment within the chuck of a conventional power drill. A housing 108 is rigidly attached to this shaft 106. A drive bit 110, which has a bifurcated hexagonal shape as described above, is expanded by contact with a tapered portion 112 of the shaft 108. The drive bit 1 10 and the housing 108 engage one another by means of a left-hand threads 114, 116. For the removal of a screw, the power drill is set to rotate the screwdriver 102 in a counter-clockwise direction, which is normal for unscrewing, and the drive bit 110 is placed in engagement with the socket head of the screw. After the drill is turned on, a first portion of the rotation causes the expansion of the drive bit 110 until the screw is engaged tightly, preventing further rotation of the housing 108 relative to the drive bit 110. Thus, further rotation of the housing 108 causes the removal of the screw by rotation of the drive bit 110. A pin 118 extending from the drive bit 110 within a slot 120 of the housing 108 is preferably used to limit the rotation of the drive bit 110 within the housing, so that a limit is placed on the expansion of the drive bit 110. An additional device, such as a chuck key, may be provided to facilitate the rotation of the drive bit 110 relative to the housing 108 when it is necessary to remove the screw from the drive bit 110. While the threads are shown as engaging the drive bit on the housing, alternately, threads may engage the drive bit directly to the shaft.

Figure 9:
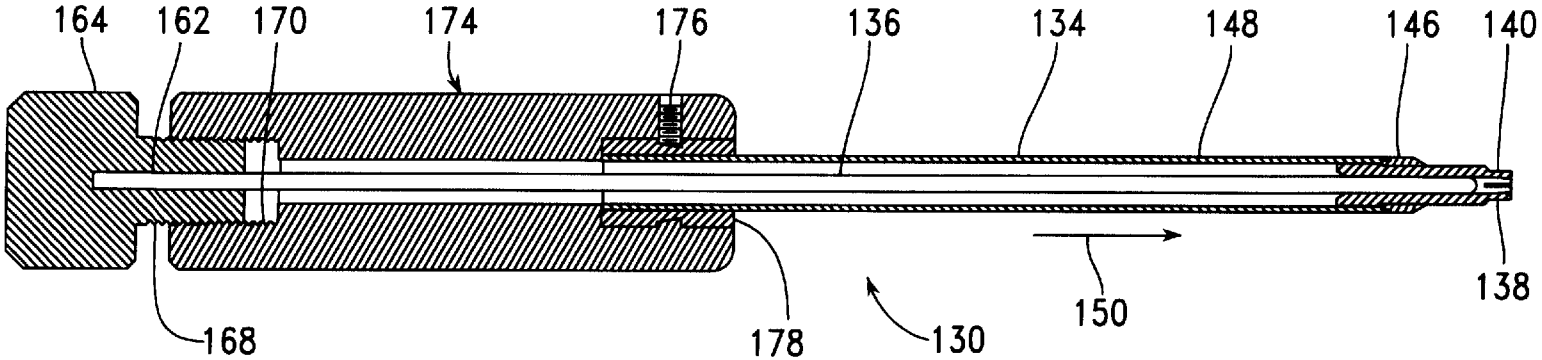
FIG. 9 is a longitudinal cross-sectional view of a screwdriver built in accordance with a fourth version of the present invention.
Figure 11:
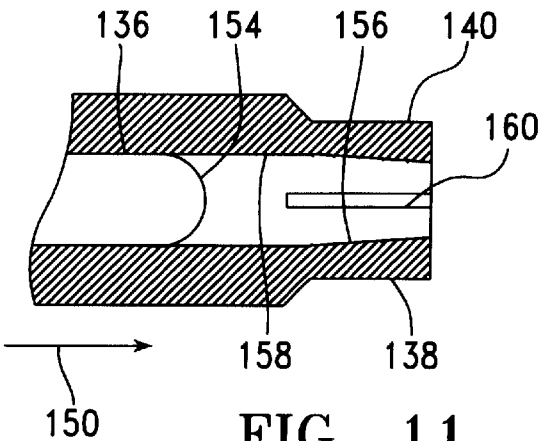
FIG. 11 is a fragmentary cross-sectional view of the distal tip portion of the screwdriver of FIG. 9.
Figure 10:
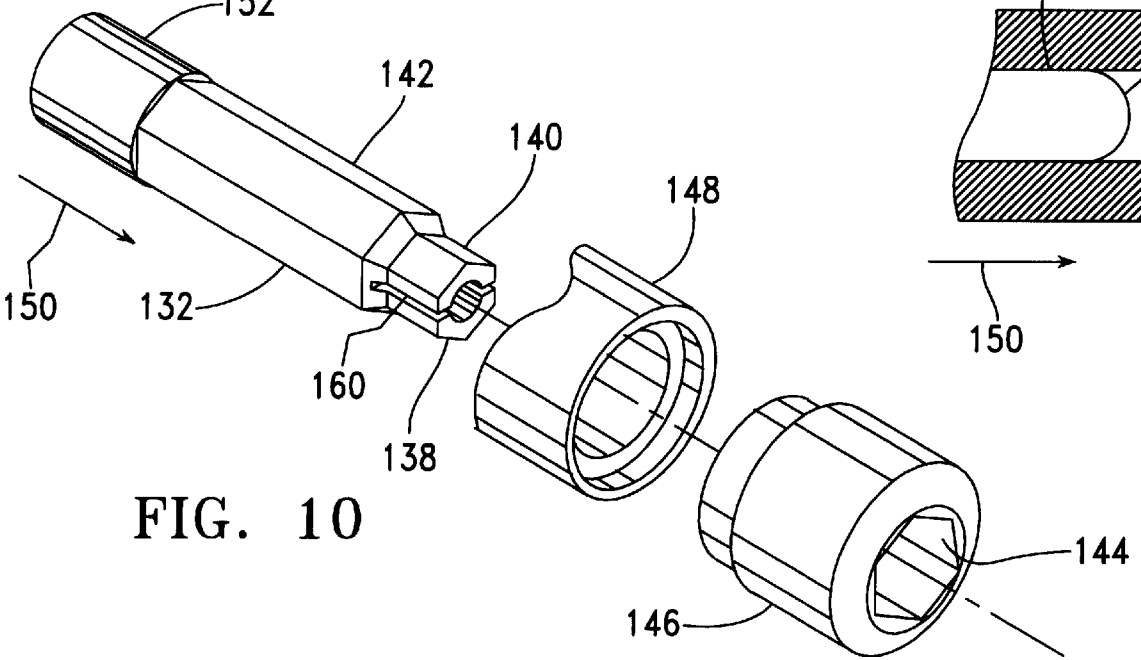
FIG. 10 is a fragmentary exploded isometric view of a distal tip portion of the screwdriver of FIG. 9.

FIGS. 9–11 show a screwdriver 130 built in accordance with a fourth version of the present invention, with FIG. 9 being a longitudinal cross-sectional view thereof, with FIG. 10 being an exploded isometric view of a distal tip portion thereof, and with FIG. 11 being a fragmentary longitudinal cross-sectional view of the distal tip portion thereof. In this screwdriver 130, an interchangeable drive bit 132 is held in position within a distal tip of a hollow shaft 134 by means of a pushrod 136, which also expands segments 138 of a driving portion 140 of the drive bit 132 to engage a socket within the screw (not shown) to be driven.

The drive bit 132 includes shaft engaging surfaces 142, which are arranged in a hexagonal pattern to engage similarly arranged bit engaging surfaces 144 of a distal end portion 146 of the hollow shaft 134. The distal end portion 146 is rigidly attached to the remaining portion 148 of the hollow shaft 134 by means, for example, of soldering or welding. The engagement of the shaft engaging surfaces 142 with the bit engaging surfaces 144 prevents rotational movement of the drive bit 132 within the distal end of the hollow shaft 134, so that torque can be transmitted to tighten or loosen a screw (not shown) while allowing movement of the drive bit 132 in the distal direction of arrow 150 and opposite thereto. However, the drive bit 132 also includes a flange 152, extending radially outward from a proximal end of the shaft engaging surfaces 142, which is too large in diameter to move into the bit engaging surfaces 144 of the hollow shaft 134.

As the pushrod 136 is moved in the distal direction of arrow 150, its distal tip 154 extends into a reduced-diameter tapered portion 156 of a hole 158 within the drive bit 132, moving the drive bit 132 in the distal direction of arrow 150 until the distal end of the flange 152 rests against the proximal end of the bit engaging surfaces 144. Further movement of the pushrod 136 in the distal direction of arrow 150 causes the segments 138 of the driving portion 140 to expand relative to one another, widening the distal end(s) of one or more slots 160 dividing the driving portion 140 into segments.

The proximal end 162 of the pushrod 136 is fastened within a knob 164, which includes an externally threaded portion 168 engaging an internally threaded portion 170 of a handle 172. In the example of FIG. 9, the handle 172 is fastened to the hollow shaft 134, to form a housing 174, by means of a set screw 176 engaging a sleeve 178 attached to the shaft 134.

Thus, the drive bit 132 is removed with the knob 164 and pushrod 136 completely unscrewed and removed from the housing 174. The drive bit 132 is inserted within the housing 174 on the distal tip 154 of the pushrod 136, with the knob 164 being screwed inward to hold the drive bit 132 in place within the hollow shaft 134 and to rigidly engage a screw by expansion of the driving portion 140 of the drive bit 132.

While a screwdriver built in accordance with the present invention is particularly useful in the installation of screws within fragile bone and in the removal of screws therefrom, it is understood that this invention is useful in a number of other fastening and unfastening procedures.

While the present invention has been described in its preferred versions or embodiments with some degree of particularity, it is understood that this description has been given only by way of example, and that numerous changes in the details of construction, fabrication, and use, including the combination and arrangement of parts, may be made without departing from the spirit and scope of the invention.

I claim:

1. Apparatus for turning a screw having a head with a socket, wherein said apparatus comprises:

a housing including a proximal housing end, a distal housing end, and a central hole extending between said proximal and distal housing ends;

a pushrod extending through said central hole;

a drive bit, attached to said distal housing end, including a segmented drive structure for engaging said socket and an internal actuation surface inclined relative to said central hole, wherein movement of a distal rod end of said pushrod in a distal direction in engagement with said internal actuation surface causes segments of said segmented drive structure to expand relative to each other for holding said screw by said socket;

a hollow shaft extending to said distal housing end, wherein said drive bit is removably attached to said hollow shaft, wherein said hollow shaft includes a bit receiving cavity, for holding said drive bit, extending inward from said distal housing end, an outer shaft surface, and an outer latching slot extending from said outer shaft surface to said bit receiving cavity, wherein said drive bit includes an outer bit surface extending within said bit receiving cavity and an inner latching slot extending inward from said outer bit surface, and wherein said drive bit is removably attached to said hollow shaft;

a handle extending to said proximal housing end; and a latching member including a latching tab movable between an engaged position, in which said latching tab extends through said outer latching slot into said inner latching slot to hold said drive bit in place within said bit receiving cavity, and a disengaged position, in which said latching tab is moved outward from said inner latching slot to release said drive bit for removal from said bit receiving cavity.

2. The apparatus of claim 1, wherein said latching member is a flexible member attached to extend from said outer shaft surface, said apparatus additionally a sliding actuator engaging a portion of said latching member, and said sliding actuator is movable along said outer shaft surface between a first position, holding said latching tab in said engaged position, and a second position, allowing said latching tab to moved into said disengaged position.

3. Apparatus for turning a screw having a head with a socket, wherein said apparatus comprises:

a housing including a proximal housing end, a distal housing end, and a central hole extending between said proximal and distal housing ends;

a pushrod extending through said central hole;

a hollow shaft extending to said distal housing end, wherein said hollow shaft includes bit engaging surfaces extending inward from said distal housing end;

a drive bit, attached to said distal housing end, including a segmented drive structure for engaging said socket and an internal actuation surface inclined relative to said central hole, wherein movement of a distal rod end of said pushrod in a distal direction in engagement with said internal actuation surface causes segments of said segmented drive structure to expand relative to each other for holding said screw by said socket, wherein said drive bit is removably attached to said hollow shaft, wherein said drive bit includes shaft engaging surfaces, extending within said bit engaging surfaces, and a flange, disposed at a proximal end of said shaft engaging surfaces, extending within said central hole, wherein engagement between said bit engaging surfaces and said shaft engaging surfaces prevents rotation of said drive bit relative to said hollow shaft while allowing movement of said drive bit relative to said hollow shaft in said distal direction and opposite said distal direction, and wherein movement of said flange into contact with a proximal end of said bit engaging surfaces stops further movement of said drive bit relative to said hollow shaft in said distal direction,; and a handle extending to said proximal housing end.

4. The apparatus of claim 3, wherein movement of said distal rod end in a distal direction in engagement with said internal actuation surfaces additionally causes movement of said flange into contact with said proximal end of said bit engaging surfaces.

5. The apparatus of claim 3, wherein said bit engaging surfaces and said shaft engaging surfaces are arranged in hexagonal patterns.

6. Apparatus for turning a screw having a head with a socket, wherein said apparatus comprises:

a housing including a proximal housing end, a distal housing end, and a central hole extending between said proximal and distal housing ends, wherein said housing includes a threaded housing surface;

a pushrod extending through said central hole, wherein said pushrod is fastened within said housing;

a drive bit, attached to said distal housing end, including a segmented drive structure for engaging said socket and an internal actuation surface inclined relative to said central hole, wherein movement of a distal rod end of said pushrod in a distal direction in engagement with said internal actuation surface causes segments of said segmented drive structure to expand relative to each other for holding said screw by said socket, wherein said drive bit includes a threaded bit surface, wherein said drive bit extends within said housing with said threaded bit surface engaging said threaded housing surface, and wherein rotation of said housing in a first direction relative to said drive bit causes said drive bit to move opposite said distal direction relative to said housing.

7. The apparatus of claim 6, wherein rotation of said drive bit in said first direction causes loosening of said screw.

8. The apparatus of claim 7, additionally comprising a pin extending from said drive bit within a slot within said housing to limit rotation of said drive bit relative to said housing.

* * * * *